US009445204B1

(12) United States Patent
Ryan

(10) Patent No.: US 9,445,204 B1
(45) Date of Patent: Sep. 13, 2016

(54) METHOD OF FORMING A SEMICONDUCTOR DEVICE AND STRUCTURE THEREFOR

(71) Applicant: SEMICONDUCTOR COMPONENTS INDUSTRIES, LLC, Phoenix, AZ (US)

(72) Inventor: James Gregory Ryan, Ottawa (CA)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 14/856,070

(22) Filed: Sep. 16, 2015

(51) Int. Cl.
*H04R 25/00* (2006.01)
*H04R 31/00* (2006.01)

(52) U.S. Cl.
CPC ..... *H04R 25/50* (2013.01); *H04R 25/554* (2013.01); *H04R 31/00* (2013.01)

(58) Field of Classification Search
CPC .. H04R 25/50; H04R 25/554; H04R 25/305; H04R 25/65; H04R 25/505; H04R 31/00; H04R 2420/65; H04R 2420/03
See application file for complete search history.

(56) References Cited

U.S. PATENT DOCUMENTS

| | | | | |
|---|---|---|---|---|
| 6,813,363 | B2 | 11/2004 | Vonlanthen | |
| 7,286,678 | B1 | 10/2007 | Bachler et al. | |
| 8,351,627 | B2 | 1/2013 | Chan et al. | |
| 9,008,341 | B2 | 4/2015 | Ryan | |
| 2004/0047483 | A1 | 3/2004 | Bauman | |
| 2006/0256987 | A1 | 11/2006 | Beilin | |
| 2007/0009124 | A1* | 1/2007 | Larsen | H04R 25/554 381/315 |
| 2008/0008340 | A1 | 1/2008 | Bachler et al. | |
| 2008/0260193 | A1 | 10/2008 | Westermann et al. | |
| 2009/0052706 | A1 | 2/2009 | Gottschalk et al. | |
| 2009/0103754 | A1 | 4/2009 | Gottschalk et al. | |
| 2010/0067707 | A1 | 3/2010 | Schwerdtner | |
| 2010/0111315 | A1 | 5/2010 | Kroman | |
| 2010/0208906 | A1 | 8/2010 | Vonlanthen | |
| 2011/0002489 | A1 | 1/2011 | Schefer | |
| 2011/0156898 | A1* | 6/2011 | Taillefer | G08B 1/08 340/539.11 |
| 2013/0251179 | A1* | 9/2013 | Aschoff | G06F 8/31 381/314 |
| 2015/0125013 | A1* | 5/2015 | Secall | G10L 19/167 381/315 |
| 2015/0139459 | A1* | 5/2015 | Olsen | H04R 1/1091 381/315 |

* cited by examiner

*Primary Examiner* — Tuan D Nguyen
(74) *Attorney, Agent, or Firm* — Robert F. Hightower

(57) ABSTRACT

In one embodiment, a personal amplification device may be configured to operate as a master and communicate to another personal amplification device that operates as a slave. The master may be configured to send signals to the slave device and control the slave device changing operation according to information sent in the sent signals.

20 Claims, 7 Drawing Sheets

| | | In 1, In 0 Values For | | |
|---|---|---|---|---|
| Connection 44 | Connection 43 | Out +, Out - = 0,1 | Out +, Out - = 1,0 | Code |
| Open | Open | 00 | 00 | 0 |
| Open | To 38 (out +) | 00 | 01 | 1 |
| Open | To 39 (out -) | 01 | 00 | 4 |
| To 38 (out +) | Open | 00 | 10 | 2 |
| To 38 (out +) | To 38 (out +) | 00 | 11 | 3 |
| To 38 (out +) | To 39 (out -) | 01 | 10 | 6 |
| To 39 (out -) | Open | 10 | 00 | 8 |
| To 39 (out -) | To 38 (out +) | 10 | 01 | 9 |
| To 39 (out -) | To 39 (out -) | 11 | 00 | 12 |

| | | In 1, In 0 Values For | | |
|---|---|---|---|---|
| Connection 44 | Connection 43 | Out +, Out - = 0,1 | Out +, Out - = 1,0 | Code |
| Open | Open | 00 | 00 | 0 |
| Open | To 38 (out +) | 00 | 01 | 1 |
| Open | To 39 (out -) | 01 | 00 | 4 |
| To 38 (out +) | Open | 00 | 10 | 2 |
| To 38 (out +) | To 38 (out +) | 00 | 11 | 3 |
| To 38 (out +) | To 39 (out -) | 01 | 10 | 6 |
| To 39 (out -) | Open | 10 | 00 | 8 |
| To 39 (out -) | To 38 (out +) | 10 | 01 | 9 |
| To 39 (out -) | To 39 (out -) | 11 | 00 | 12 |

*FIG. 4*

| Code | Left/Right Designation |
|---|---|
| 0 | None |
| 1 | Left |
| 4 | Left |
| 2 | Left |
| 3 | Left |
| 6 | Right |
| 8 | Right |
| 9 | Right |
| 12 | Right |

90

METHOD OF FORMING A SEMICONDUCTOR DEVICE AND STRUCTURE THEREFOR

BACKGROUND OF THE INVENTION

The present invention relates, in general, to electronics, and more particularly, to hearing aid devices and/or personal sound amplification devices, structures thereof, semiconductor devices, and methods of forming such devices.

In the past, hearing aids were manufactured to assist people with hearing difficulties. Some hearing aids included detachable receivers that included a loudspeaker of the hearing aid. Various methods were provided for a controller portion of the hearing aid to determine the type of receiver that was attached to the controller. In some applications, it was desirable for a user to have two hearing aids, one for each ear. In some cases, the user could connect receivers to the incorrect hearing aid components which often resulted in undesirable audio amplification for the user.

Accordingly, it is desirable to have a detection apparatus and method that may is easier for the user to identify.

BRIEF DESCRIPTION OF THE DRAWINGS

FIG. 4 illustrates a table with examples of some values or alternately states of some of the signals formed by the system of FIG. 2 in accordance with the present invention.

Figure 1:
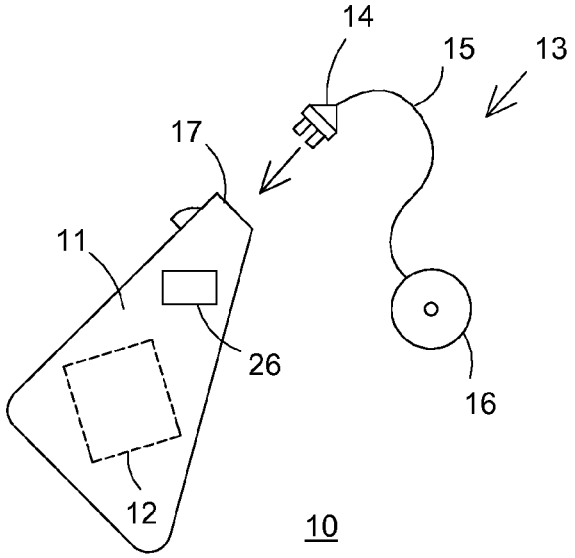
FIG. 1 illustrates an example of a portion of an embodiment of a hearing aid system in accordance with the present invention.

For simplicity and clarity of the illustration(s), elements in the figures are not necessarily to scale, some of the elements may be exaggerated for illustrative purposes, and the same reference numbers in different figures denote the same elements, unless stated otherwise. Additionally, descriptions and details of well-known steps and elements may be omitted for simplicity of the description. It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten percent (10%) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein. Reference to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but in some cases it may. Furthermore, the particular features, structures or characteristics may be combined in any suitable manner, as would be apparent to one of ordinary skill in the art, in one or more embodiments.

DETAILED DESCRIPTION OF THE DRAWINGS

FIG. 1 illustrates an example of a portion of an embodiment of a hearing aid system 10. One example of a hearing aid is disclosed in U.S. Pat. No. 9,008,341 issued to James Ryan which is hereby incorporated herein by reference. In one embodiment, hearing aid system 10 can include a hearing aid component or circuit or hearing aid shell 11 and a detachable receiver 13. In one embodiment, component 11 can include various circuits such as for example, a controller 12, one or more amplifier circuits, one or more processing circuits, a driver circuit, a microphone, a battery compartment, a battery, push buttons, or other user controls. For example, an embodiment of controller 12 may include one or more amplifier circuits, and/or one or more processing circuits, and/or a driver circuit. In one embodiment, detachable receiver 13 can include a speaker module 16, wiring 15, and a detachable connector 14, such as for example a plug. An embodiment of component 11 may include a socket 17 or other type of connector to which connector 14 may be attached to provide signal paths between component 11 and module 16. A portion of or alternately all of module 16 may, in some embodiments, be surrounded by a soft tip designed to provide patient comfort when fitted into an ear canal.

During the operation of system 10, an electrical signal can be transferred from the circuits within hearing aid component 11 toward detachable receiver 13 via an output terminal or output. In one example embodiment, the output can be connected to an output of an amplifier circuit in component 11, such as in controller 12 for example. The electrical signals or output signals on the output terminals may be formed as analog signals or as digital signals such as pulse density modulation (PDM) signals or pulse width modulation (PWM) signals or as other digital signals. An embodiment of system 10 may include forming controller 12 with an amplifier that is configured to operate with and/or provide signals to an embodiment of module 16 that may include a receiver that may be referred to as a zero-bias receiver in order to substantially eliminate a d.c. bias on module 16. Those skilled in the art will appreciate that analog outputs or other types of digital outputs may also be used. Controller 12 may, in some embodiment, have two amplifier outputs that, in some embodiments, may be out of phase with each other. In some embodiments that include using analog signals, the connections 43 and/or 44 may include resistors.

Receiver 13 may also be configured to send information signals to component 11 or to controller 12 to assist component 11 in identifying information about receiver 13. The identification information of receiver 13 can be embodied by a connection arrangement among an encoding connection or encoding configuration and the electrical output signals from component 11. The encoding configuration can be implemented, for example, within detachable connector 14 or within module 16 or within other locations of receiver 13. The encoding configuration, thus the information, can be detected based on values or states of the drive signals and information signals received from module 16 on inputs of component 11 via the encoding configuration. If an input of component 11 is connected to any output of component 11, the input will change its state. If an input of component 11 is unconnected to any output terminal, the input will not change its state. Component 11 may include circuits to decode the information, for example, controller 12 may include a decoder for decoding the information of detachable receiver 13 based on the states of the information signals. The audio processing performed by component 11 may, in an embodiment, be adapted based on the information received from receiver 13.

In some embodiments, component 11 may include a wireless communication circuit 26. Circuit 26 may be configured to send and/or receive wireless signals and/or information to other electronic devices that are external to component 11. Circuit 26 may be configured to communicate with the other device using know communication standards including Bluetooth, IEEE802.11, or other well know standards, or alternately may be configured to operate with a non-standard communication protocol and method.

Figure 2:
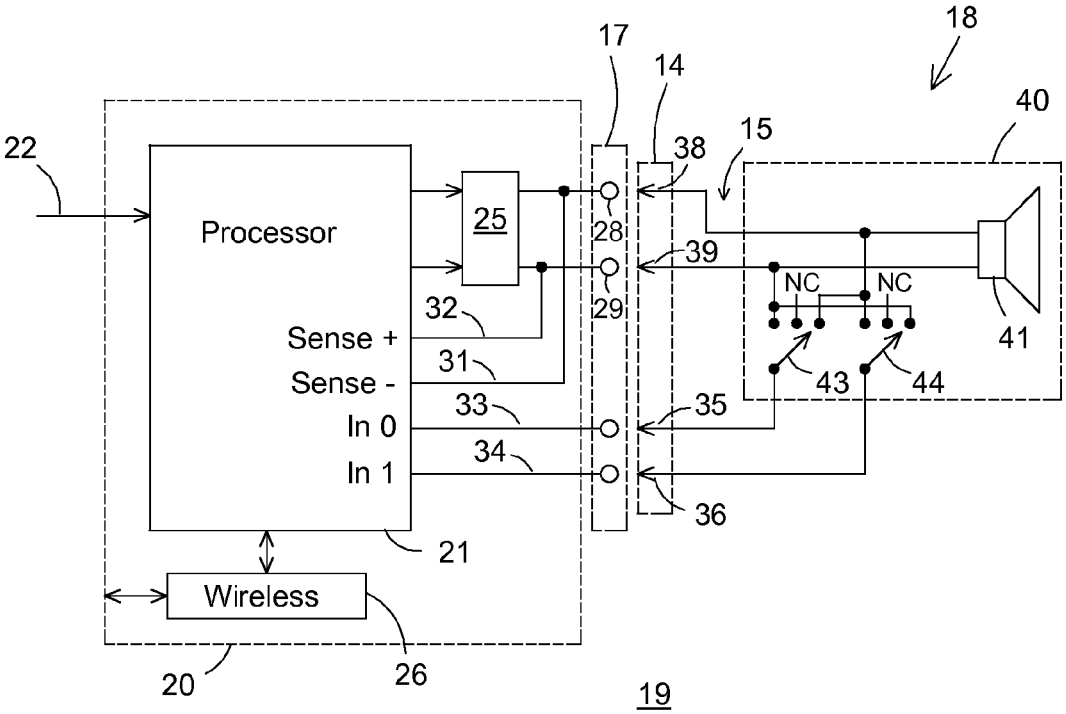
FIG. 2 schematically illustrates an example of a portion of an embodiment of a hearing aid system that can be an alternate embodiment of the system of FIG. 1 in accordance with the present invention.

FIG. 2 schematically illustrates an example of a portion of an embodiment of a hearing aid system 19 that can be an alternate embodiment of system 10. In one embodiment, system 19 may be substantially similar to system 10. System 19 includes a control circuit or controller 20 that may be an example embodiment of a portion of circuits that may be within an embodiment of component 11 (FIG. 1). In a non-limiting example, controller 20 may be an alternate embodiment of controller 12 of component 11. In some embodiments, at least a portion of circuit 26 may be a portion of circuit 20, or may be external to circuit 20 in other embodiments. System 19 also includes an example of a portion of an embodiment of a detachable receiver 18 that may be an example of an alternate embodiment of receiver 13 of FIG. 1.

Controller 20 may include various processing circuits or control circuits, such as a processor or processor circuit 21 for example, which may be configured to receive a signal 22 from a microphone or a signal that is representative of a signal from a microphone, process the received signal using various hearing aid algorithms, and form an output signal to excite receiver 18 to form audio signals that are representative of signal 22. Those skilled in the art will understand that the various algorithms executed by circuit 21 may be configured to use various parameters that are personalized to the individual hearing needs and properties of a person that uses system 19. For example, circuit 21 may include a digital signal processor (DSP) that may include one or more amplifier circuits, one or more analog-to-digital converter circuits, one or more sigma-delta converter circuits, various computer processing circuits, and/or various other known circuits used for hearing aids. Controller 20 may also include a driver circuit 25 that is configured to receive either digital or analog signals from circuit 21 and form output signals to excite receiver 18. For example, circuit 25 may, in an embodiment, include an H-Bridge circuit that converts digital signals from circuit 21 to the output signals such as for example an output+ signal or out+ and an output− signal or out− on respective output terminals or outputs 28 and 29. Outputs 28 and 29 may be detachably connected to respective input terminals or inputs 38 and 39 of connector 14 to provide an electrical path between receiver 18 and signals out+ and out−.

Receiver 18 may include a speaker module 40 that may have an embodiment that is similar to an embodiment of module 16 (FIG. 1). Module 40 may include a loudspeaker or speaker 41, input terminals or inputs 38 and 39 that are configured to receive signals out+ and out−, respectively, from controller 20, and output terminals or outputs 35 and 36 that provide information signals In0 and In1 to controller 20.

Figure 7:
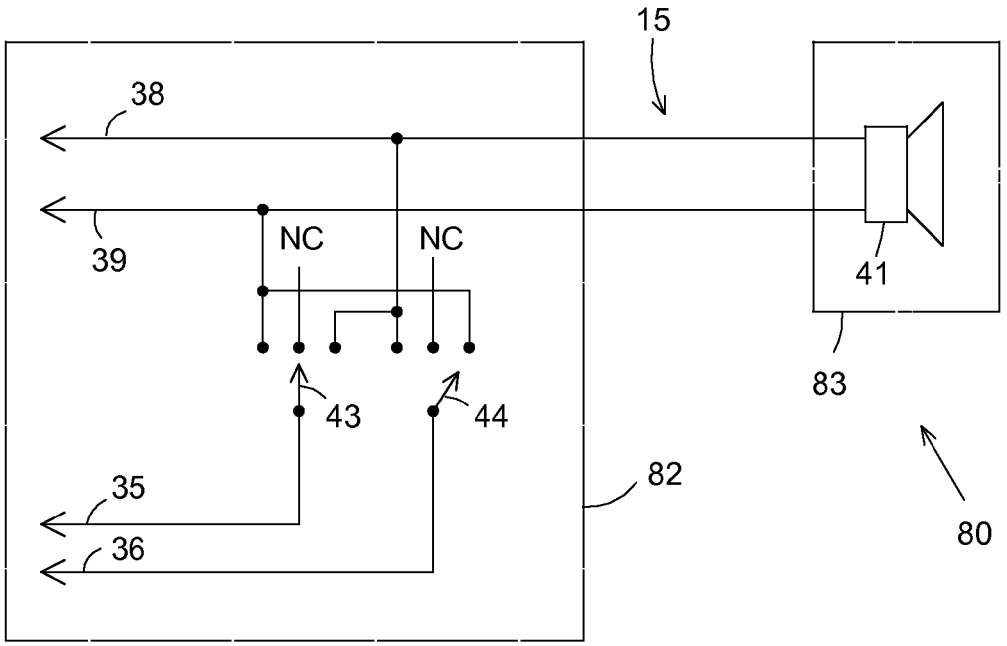
FIG. 7 schematically illustrates an example of a portion of an embodiment of a detachable receiver that may be an alternate embodiment of the detachable receiver of FIG. 1 and/or FIG. 2 in accordance with the present invention.

In one embodiment, receiver 18 may also include connections 43 and 44 that may be used to encode information about receiver 18. Connections 43 and 44 may be configured in various configurations to provide a path from either of signals out+ or out− to any of signals In0 or In1. For example, one of or both of terminals 35 and 36 may be connected to either one of terminals 38 and 39 by one or more of connections 43 and/or 44. Thus, either or both of terminals 35 and 36 may be configured to receive either of or none of output signals out+ and/or out−. For example, connections 43 and 44 may be used to form various cross-connections from terminals 38 and 39 to terminals 35 and 36. Controller 20 may form various output signals on out+ and out− which may be received by controller 20 as information signals In0 and In1 on inputs 33 and 34. Those skilled in the art will appreciate that connections 43 and 44 may be disposed in various locations in receive 18. For example, connections 43 and 44 may be located in various places along wring 15, or may alternately be disposed in the connector such as illustrated in FIG. 7.

Figure 3:
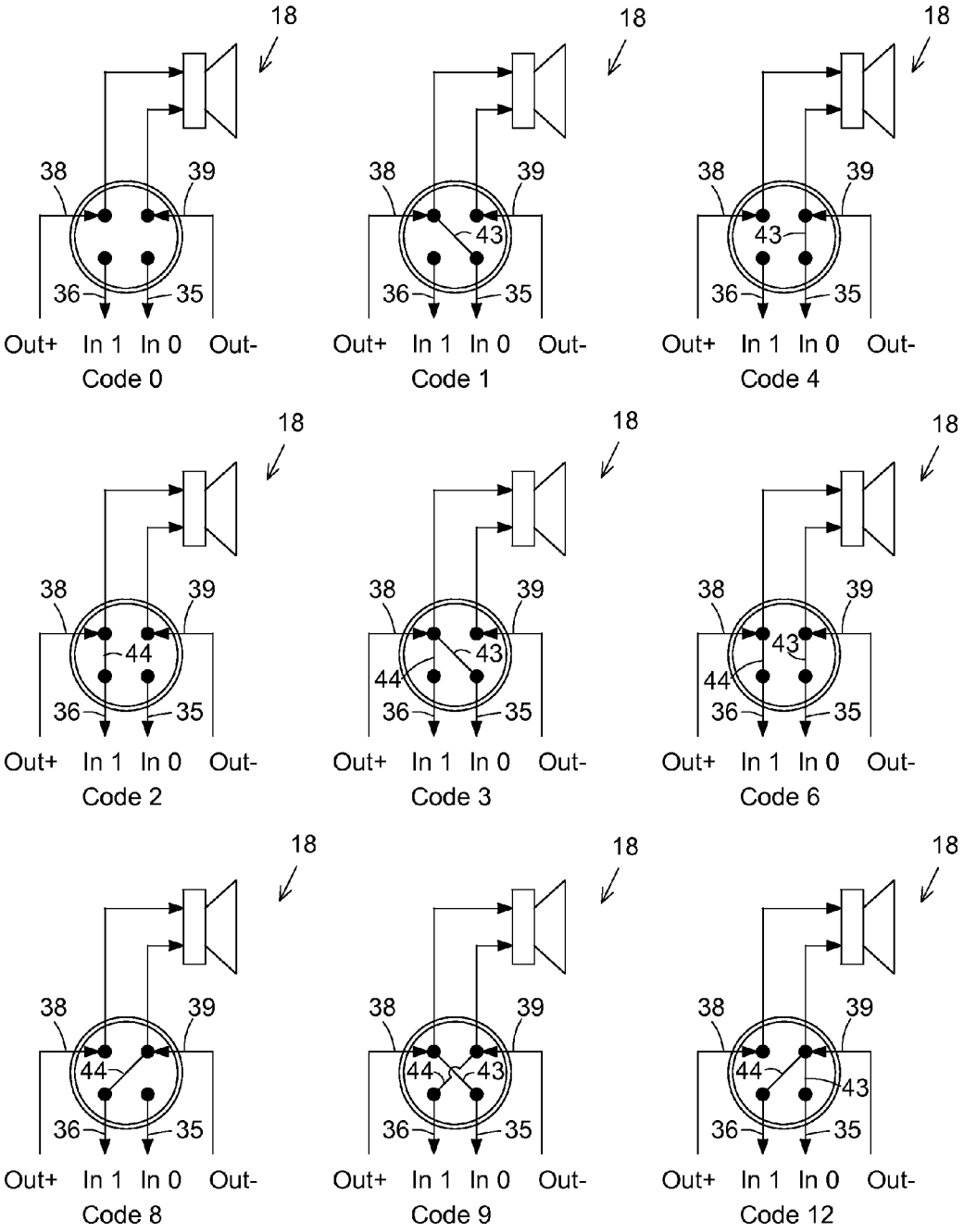
FIG. 3 schematically illustrates in a general manner nine different code configurations that may be formed by some embodiments of connections of the system of FIG. 1 and/or FIG. 2 in accordance with the present invention.

FIG. 3 schematically illustrates in a general manner nine different code configurations that may be formed by connections 43 and 44. Each code configuration has a different connection from inputs 38 and 39 to outputs 35 and 36. Because of connections 43 and 44, various values or states of signals out+ and out− form different signal configurations or states of signals In0 and In1.

FIG. 4 illustrates a table 50 illustrating examples of values or alternately states of signals In0 and IN1 that may be formed based on the configuration of connections 43 and 44 and the state or value of signals out+ and out−. This description has references to FIGS. 3 and 4. In one non-limiting example embodiment, controller 20 or circuit 21 may include a circuit (not shown) to set either of inputs 33 and 34 to a selected value if one of both of connections 43 and/or 44 are omitted, such as for example, for a code of zero. For such an example embodiment, those skilled in the art will appreciate that if signals out+ and out− are both low or at a negated state, then signals In0 and In1 will also both be at a low state regardless of the code formed by connections 43 and 44. Also, if out+ and out− are both an asserted state or at a high value, it is not possible to tell which configuration of connections 43 and 44 (FIG. 3), or codes, would cause one or both of IN0 and In1 to have an asserted state. Thus, to determine the code formed by connections 43 and 44 it is desirable to drive signals out+ and out− with opposite states. For example, out+ can be asserted and out− negated, and vice versa. The table for FIG. 4 illustrates how the various codes formed by the configurations of connections 43 and 44 may be decoded or determined.

Table 50 illustrates the various codes that can be decoded from the value of signals In0 and IN1 if the values for out+ and out− are known, according to one example embodiment of controller 20 and receiver 18. For example, as illustrated by the third and fourth columns from the left of table 50, out+ and out− are driven with opposite states. For example, according to the third column and the first row of table 50, out+ may be negated and out− asserted, and then the values of signals In0 and In1 are sensed for that set of out+ and out− values; then out+ and out− are inverted so that out+ is asserted and out− is negated, and the values of In0 and In1 are again sensed. Based on the two sets of In0 and In1 values, the code formed by connections 43 and 44 can be determined to be 0. The two different sets of out+ and out− values can be used to form two sets of In0 and In1 values that can uniquely determine any of the codes illustrated in FIGS. 3 and 4. Those skilled in the art will appreciate that in FIG. 3, the top left configuration illustrates no connections between either of inputs 38 and/or 39 and either of outputs 35 and 36, resulting in a code of zero.

Referring back to FIG. 2, circuit 21 is configured to receive signals sense+ 32 and sense− 31 that are representative of the values of signals out+ and out−, respectively. Since the value or state of signals out+ and out− are known via signals sense+ and sense−, circuit 21 can sense the value of signals In0 and In1 for the different values of out+ and out− and determine the code represented by connections 43 and 44, such as illustrated in table 50. Additionally, since circuit 21 can use the sense+ and sense− signals to determine the value or state of signals out+ and out− for any signals driven to speaker 41, system 19 can determine the code configured by connections 43 and 44 at any time during the operation of system 19. For example, at any time during the method of exciting speaker 41 with audio representative signals in response to signal 22.

In some prior systems, the system could only determine information about a receiver during a start-up procedure before the system was used to send audio representative signals to the speaker. It has been found that in some such systems the start-up sequence used to determine the code in the receiver caused undesirable audio noises that were not acceptable to the hearing aid users. The audible noises may sometimes be referred to as clicks or pops or other types of noise.

However, since system 19 can monitor and determine the state or value of signals out+ and out− at any time speaker 41 is driven, controller 20 can sense the state of out+ and out− and receive the state of signals In0 and In1 and determine the codes that correspond to the out+, out−, IN0, and In1 values or states, such as is illustrated in table 50 of FIG. 4. Consequently, system 19 is not limited to driving receiver 18 only during a start-up procedure which forces the state of out+ and out−. System 19 can decode the code of receiver 18 at any time during the operation of system 19. Accordingly, system 19 minimizes undesirable audible noise during the sequence to determine the information of receiver 18 since system 19 uses the normal audio amplification or audio processing of received audio signals to determine the information of receiver 18.

Those skilled in the art will appreciate that signals out+ and out− may be used in an embodiment of component 11 (FIG. 1) to drive receiver module 16, and that an embodiment of module 16 may include a speaker similar to speaker 41. Those skilled in the art will also appreciate that in other embodiments, the output signal may be used directly as the sense signals (sense+ and sense− 31 and 32) instead of forming separate sense signals.

Figure 5:
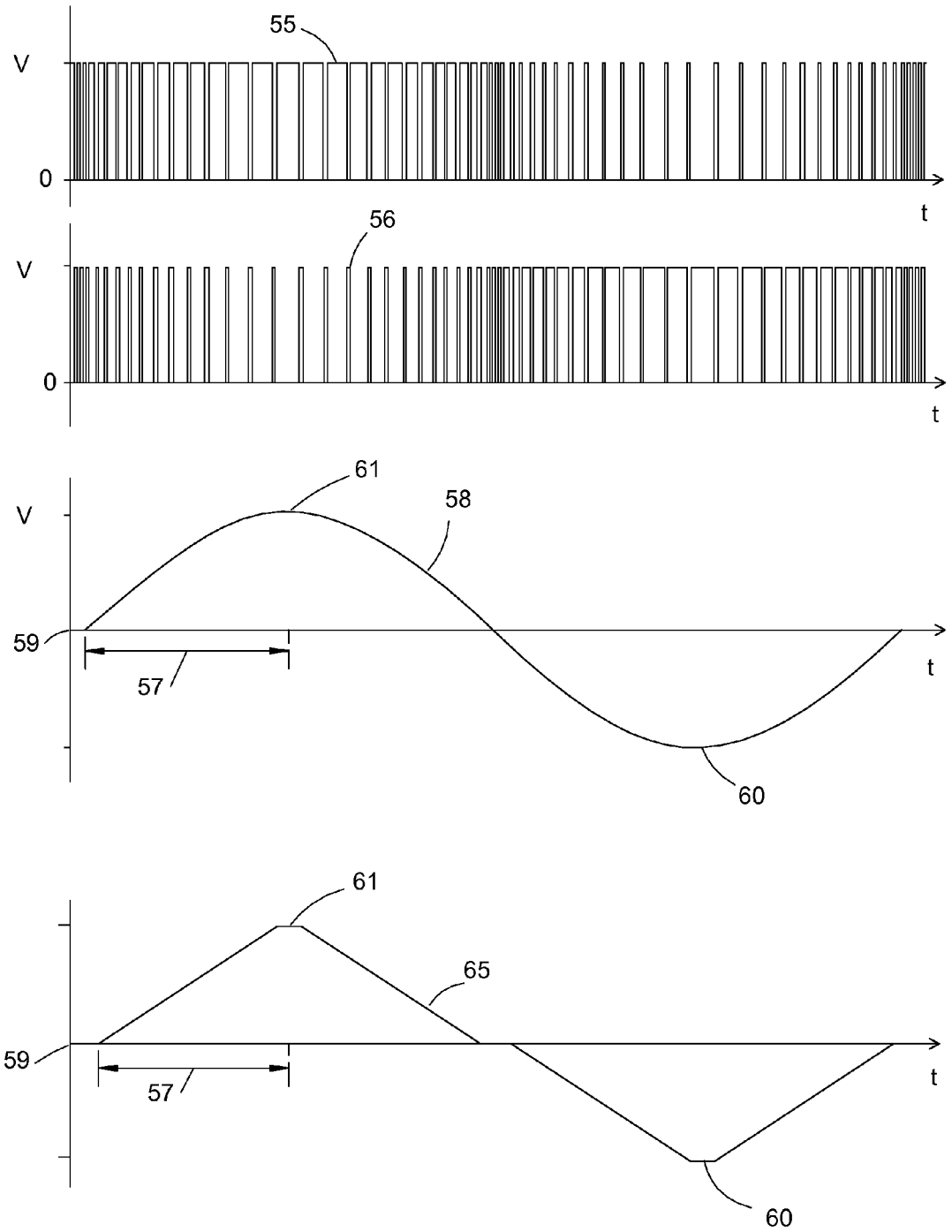
FIG. 5 illustrates a graph having plots illustrating examples of some signals that may be formed by an embodiment of the system of FIG. 1 or FIG. 2 in accordance with the present invention.

FIG. 5 illustrates a graph having plots illustrating examples of some signals that may be formed by an embodiment of system 10 or alternately system 19 for an alternate method of minimizing audible noise during a method to determine the receiver information. A plot 55 illustrates an example of values of an output signal formed to excite a speaker, such as for example signal out+ formed to excite speaker 41, relative to a common reference value, such as for example a ground reference. A plot 56 illustrates an example of values of another output signal, such as signal out−, formed to excite the speaker relative to the common reference value. A plot 58 illustrates an excitation signal at the speaker in response to the output signals illustrated by plots 55 and 56. A plot 65 illustrates an alternate embodiment of an excitation signal. The abscissa indicates time and the ordinate indicates increasing value of the illustrated signal. Those skilled in the art will appreciate that the speaker may, in some embodiments, function somewhat as a low pass filter that may shape the output signals such that the resulting waveform of the excitation signal at the speaker may have a waveshape that may be different from the waveshape of the output signals. In a non-limiting embodiment, the resulting waveshape of the excitation signal may be similar to either of plots 58 or 65, or other waveshapes. The signals of plots 55 and 56 are formed to substantially form a signal similar to plot 58. Those skilled in the art will appreciate that the output signals, such as for example signals out+ and out−, may have a different shape to form the signal illustrated by plot 65.

It has been found that applying a gradually changing excitation signal, such as having a gradually increasing or gradually decreasing value, to the speaker can minimize audible noise in the speaker. For example, the output signals may be controlled to form the excitation signal at the speaker to have the slowly varying waveform, for example having a slowly increasing value of a slowly decreasing value. In an embodiment, the controller for the system, such as for example controller 12 or 20, may be configured to control the output signals to form the gradually changing excitation signal. The waveform of plot 58 illustrates a sinusoid waveform that may be one example of a gradually changing excitation signal that minimizes audible noise. However, the controller may be configured to control the output signals to form the waveshape of the excitation signal to be similar to plot 65 or similar any other waveshape that has a gradually changing or slowly varying waveshape. It has been found that in an embodiment audible noise may be minimized if the excitation signal is formed with a sufficiently large time interval for the value of the excitation signal to rise or fall from a common mode value to a peak value, for example a quarter of a cycle. One example of such a time interval is illustrated by an arrow 57 in plots 58 and 65. The common mode value of plots 58 and 65 is illustrated by a value 59. In one example embodiment, a time interval of no less than approximately ten (10) milliseconds was found to minimize the noise. A time interval of approximately fifty (50) milliseconds was found to minimize the noise in another embodiment. Another embodiment with a time interval between approximately ten and approximately fifty (10-50) milliseconds was found to minimize the noise. It is believed that one skilled in the art would not expect to excite the speaker with the gradually changing excitation signal because the frequency of such a signal is outside the normal hearing range, thus, is outside the range typically used for exciting a speaker of a hearing aid. For example, in one embodiment the frequency of the excitation signal may be less than approximately twenty-five Hertz (25 Hz). In another embodiment, the frequency of the excitation signal may be between approximately five and approximately twenty-five Hertz (5-25 Hz).

Assume that system 19 (FIG. 2) is configured to form signals out+ and out− as PDM signals. Those skilled in the art will understand that the out+ signal generally may be formed to have more pulses than the out− signal in order to increase the value of the excitation signal, and to have fewer pulses than the out− signals in order to reduce the value of the excitation signal. The waveform of the excitation signal will be different from the waveform of the out+ and out− signals. Controller 20 may be configured to control the PDM out+ and out− signals to form the desired gradually increasing excitation signal, such as for example either waveform of plots 58 or 65, or other gradually increasing excitation signal.

In an alternate embodiment, assume that a system such as system 10 is not able to sense the value or state of the output signals, thus, such a system may have to form special output signals that are dedicated to the method of determining the receive information such as the code of the encoding connections, such as for example connections 43 and 44. Such a system may have to form the special or dedicated output signals during a start-up sequence, or in response to connecting a receiver to the component, such as connecting receiver 15 or receiver 18, to respective component 11 or controller 20. Configuring the controller of the system to control the dedicated output signals to form the excitation signal to have the gradually increasing waveform, such as illustrated by plot 58 or plot 65 for example, minimizes the audible noise formed during the detection method.

For each excitation signal waveform of plots 58 and 65, the positive peaks of the excitation signal, such as a positive peak 61, usually coincides with an asserted state of the output signal on the positive amplifier output, such as out+ for example. Positive peak 61 also usually coincides with a low voltage or negated state on the negative amplifier output, such as out− for example. At this point in the cycle, any information signals received by the controller, such as signals In0 and/or In1 for example, result from the state or value of the positive amplifier output, such as out+ for example. Conversely, peaks in the negative excursion of the excitation signal, such as for example a negative peak 60, usually coincides with an asserted state or high voltage on the negative amplifier output, such as out− for example. Negative peak 60 also usually coincides with low voltage or negated state on the positive amplifier output, such as out+ for example. At this point in the cycle, any information signals received by the controller, such as In0 and/or In1 for example, result from the state or value of the negative amplifier output, such as out− for example. Thus, the states of the positive and negative amplifier output signals can be used along with the received information signals to decode the information of the receiver, such as illustrated in table 50 of FIG. 4 for example.

Alternately, it can be seen from table 50 that only one of the output signals out+ or out− is needed at a time to determine the encoded information. For example, only the positive output out+ may be controlled to form a first slowly varying waveform and sensing the information signals followed by controlling only the negative output out− to form a second slowly varying waveform and sensing the information signals to determine the receiver information.

This encoding system can also be applied to a detachable receiver for a stereo system, or two-way loudspeaker connection. For such an embodiment, the controller 20 may be configured with a stereo amplifier and two amplifier outputs for each receiver resulting in two out+ outputs and two out− outputs. Consequently, the number of connection states may be increased to five: not connected (open), connected to the left positive-amplifier output, connected to the left negative-amplifier output, connected to the right positive-amplifier output, and connected to the right negative-amplifier output. For such a stereo system provided with n digital inputs, it is possible to encode $5^n$ unique identification states.

FIG. 7 schematically illustrates an example of a portion of an embodiment of a detachable receiver 80 that may be an alternate embodiment of either of receivers 13 or 18 of FIG. 1 or 2, respectively. Receiver 80 includes a speaker module 83 and also includes a connector 82 that may have an embodiment that may be an alternate embodiment of connector 14 (FIGS. 1 and 2). However, connector 82 may include connectors 43 and 44 disposed within connector 82 instead of in speaker module 83.

Figure 6:
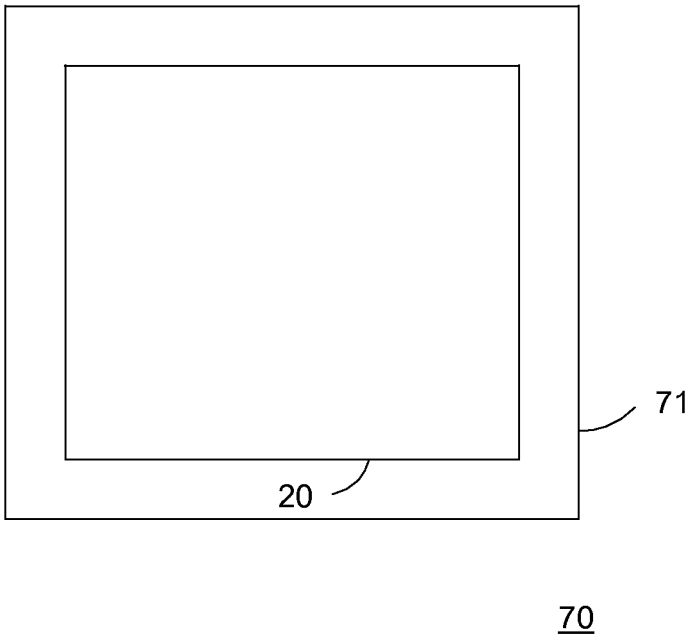
FIG. 6 illustrates an enlarged plan view of a portion of an embodiment of a semiconductor device that may include the controller of FIG. 1 or FIG. 2 or FIG. 8 or FIG. 11 in accordance with the present invention.

FIG. 6 illustrates an enlarged plan view of a portion of an embodiment of a semiconductor device or integrated circuit 70 that is formed on a semiconductor die 71. In an embodiment, any one of controllers 12 or 20 or controllers of components 107 or 81 may be formed on die 71. Die 71 may also include other circuits that are not shown in FIG. 6 for simplicity of the drawing. The controller and device or integrated circuit 70 may be formed on die 71 by semiconductor manufacturing techniques that are well known to those skilled in the art.

Figures 8, 9:
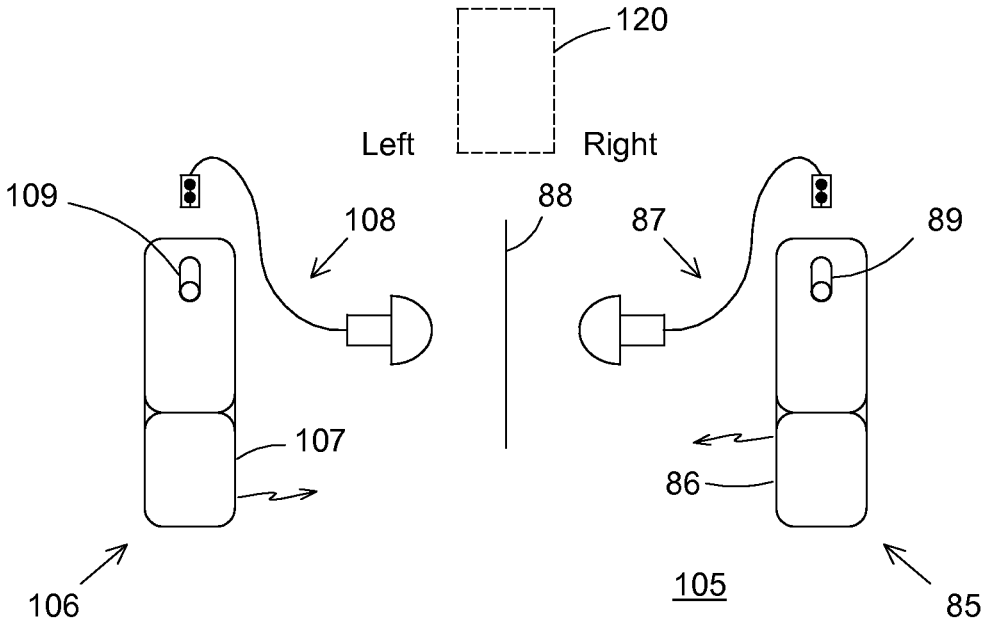
FIG. 8 illustrates an example of a portion of an embodiment of a hearing aid system that may include multiple audio devices in accordance with the present invention.
FIG. 9 includes a table illustrating embodiments of some non-limiting examples of the examples of methods to use the information in the table of FIG. 4 in accordance with the present invention.

FIG. 8 illustrates an example of a portion of an embodiment of a hearing aid system 105 that may include multiple audio devices, for example multiple hearing aids. In one non-limit example, system 105 may include a left hearing aid system 106 that includes a hearing aid component 107 and a detachable receiver 108. System 105 may also include a right hearing aid system 85 that includes a hearing aid component 86 and a detachable receiver 87. Systems 106 and 85 may have embodiments that are substantially similar to embodiments of system 10 (FIG. 1) and/or system 19 (FIG. 2). Components 107 and 86 may have embodiments that may be substantially similar to either of component 11 (FIG. 1) and/or controller 20 (FIG. 2). In some embodiments, either or both of components 107 and 86 may include controllers similar to controller 12 (FIG. 1) or controller 20 and/or processor 21 (FIG. 2). Receivers 108 and 87 may have embodiments that may be substantially similar to either of receivers 13 (FIG. 1) or 18 (FIG. 2).

However, system 106 may be configured as a left hearing aid that a person would use in a left ear, and system 85 may be configured as a right hearing aid that a person would use in a right ear. An embodiment may include that receiver 108 may be configured to fit around a user's left ear and be inserted into the left ear and receiver 87 may be configured to fit around a user's right ear and be inserted into the right ear. For example, a line 88 may represent the location of a person's head relative to receivers 108 and 87. In some embodiments receivers 108 and 87 may be substantially similar, such as for example substantially similar electronics, but may be physically different. In some embodiments, the properties of the receivers may also be different. For example, the wiring, such as wiring 15 (FIGS. 1 and/or 2), may be manufactured with a curvature to accommodate fittings of the right ear or may have a curvature to accommodate fittings of the left ear. Since a person's right ear and left ear may have different hearing profiles, the algorithms executed by components 107 and 86 may be different in order to accommodate for the different hearing profiles. Some embodiments of the receivers may also include a color on the exterior of the receiver to inform the user of the difference in the receivers or alternately may include lettering such as R and/L for right and left, or alternately may include both color and lettering or may include other designations. In some embodiments the controller or processor of components 107 and 86 and any firmware or software therein may be substantially the same but may have different parameters to provide appropriate processing for the different hearing profiles.

In some embodiments, either of components 107 or 86 may include the parameters for both ears and select the appropriate parameters to use during operation in response to detecting that a right or left receiver is attached to the component. In some embodiments, components 107 and/or 86 may be able to accept either of receivers 108 or 87. For example, if receiver 87 is connected to component 107, component 107 may be configured to detect the right receiver instead of a left receiver and to use algorithms or parameters or other processing configurations that are appropriate for the right ear instead of for the left ear. In some embodiments, the method of determining information about a receiver, such as for example illustrated in table 50 of FIG. 4 and the descriptions thereof, may also be used as a portion of a method to identify the type of receiver attached to components 107 and/or 86, for example, a left or right type of receiver, and to determine the parameters to use in operation.

FIG. 9 includes a table 90 illustrating embodiments of some non-limiting examples of examples of how a method may utilize the codes of table 50 (FIG. 4) to identify a left or right receiver. In a non-limiting example, if component 107 or 86 detects a code of 1, 2, 3, or 4, from a receiver, the component can be configured to identify the receiver as a left receiver and use appropriate parameters for the hearing profile of the person's left ear. In a non-limiting example, if component 107 or 86 detects a code of 6, 8, 9, or 12, from a receiver, the component can be configured to identify the receiver as a right receiver and use appropriate parameters for the hearing profile of the person's right ear.

Figure 10:
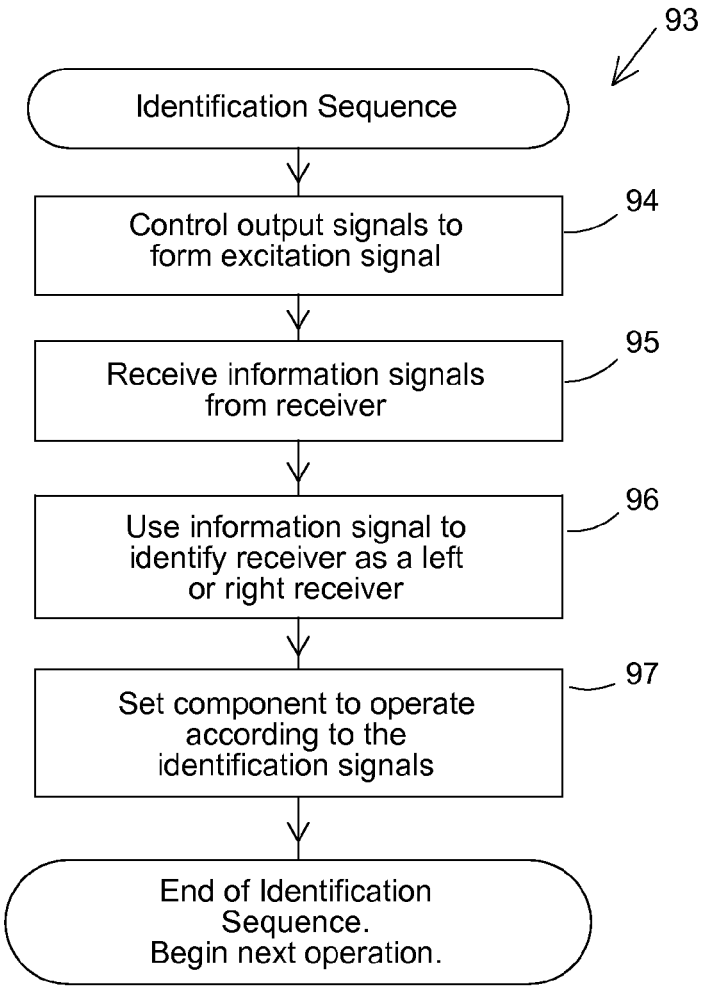
FIG. 10 illustrates in a general manner a flowchart that illustrates an example embodiment of some steps in a non-limiting example of a method of identifying a receiver in accordance with the present invention.

FIG. 10 illustrates in a general manner a flowchart 93 that illustrates a non-limiting example embodiment of some steps in a non-limiting example of a method of identifying a receiver as either a left receiver or a right receiver. At a step 94, the component, such as for example one or more of components 107 and 86, may form output signals to excite the attached receiver with an excitation signal. At a step 95, the component may receive information signals from the receiver having information about the attached receiver. At a step 96, the component can detect the information received in the information signals, can decode the information as one of the codes in table 90 for example, and use the decoded information to identify the receiver as either a left receiver or a right receiver. At a step 97, the component may be configured to select parameters to operate as either the left hearing aid system or the right hearing aid system according to the information identified in the information signals or in an alternate embodiment according to the code detected from the receiver.

Figure 11:
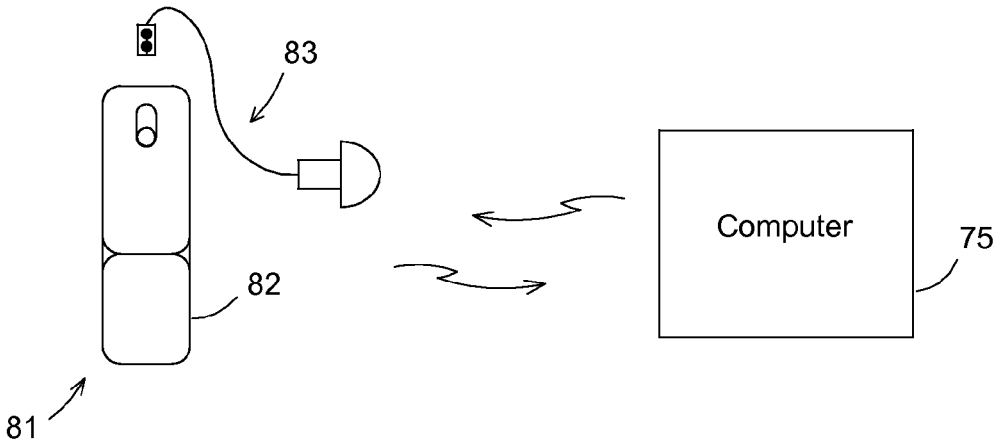
FIG. 11 illustrates in a general manner a block diagram of a system that may be used to transfer parameters to a component in accordance with the present invention.

FIG. 11 illustrates in a general manner a non-limiting example embodiment of a block diagram of a system that may be used to transfer parameters to a component, such as component 107 and/or 86 for example. A testing computer or control computer 75 may be configured to perform operations to test an individual and determine the appropriate hearing profiles, such as hearing profiles of the person's left ear and of the right ear. In some embodiments, computer 75 may be external to either of systems 106 and/or 85 (FIG. 8). Computer 75 may be configured to generate parameters for a hearing aid component, such as component 107 and/or 86 for example, in response to the hearing profile that was determined from the testing. Subsequently, a hearing aid component, such as for example one of components 107 or 86 and one of receivers 108 or 87, may be connected to computer 75 by a wire or other means, such as for example wirelessly, so that computer 75 may store the appropriate parameters into the component.

It would be advantageous for computer 75 to determine if the component to which computer 75 is connected is a right or left hearing aid component. In an embodiment, the receiver information obtained by the component, such as the receiver information described hereinbefore in relation to table 50, may be used to assist in using wireless techniques to connect computer 75 to the component and perform the operations to transfer the parameters from computer 75 to the component.

Assume for example that receiver 108 is to be connected to component 107, and that computer 75 is to transfer parameters to component 107 using wireless connection techniques. One example of suitable wireless connection technique could be a Bluetooth wireless connection or other well-known wireless transferring technique. For wireless connections, it generally is desirable to use a security key to provide a more secure connection between two wireless devices and to minimize the possibility of a wireless connection to an undesired device. In one non-limiting example of a sequence to connect component 107 with computer 75, the receiver information, or alternately the code, received from receiver 108 may be used to form a security key to assist with connecting component 107 with computer 75. For example, the receiver information from the receiver may not only identify the receiver as a left receiver or a right receiver but the information may also be used directly as a security key to assist forming the wireless connection. For example, in table 90 (FIG. 9) codes one, two, three, and four may not only identify a left receiver but the actual number of the code may be used as the security key. Similarly, codes six, eight, nine, and 12 may not only identify a right receiver but the actual number of the code may be used as the security key.

In a non-limiting example, as portion of a sequence to form a wireless connection between computer 75 and component 107, component 107 may send the receiver information, for example the number of the code, over a wireless channel as a security key. Computer 75 may receive the security key and display the security key for an operator of computer 75 to verify. In other embodiments, the receiver information received from the receiver, such as for example the receiver code, may be used by the controller within component 107 as a seed to generate a more complex key such as by a look-up table or a seed into a random number generator to generate a more complicated security key. Component 107 may then transmit the more complicated security key to computer 75. Alternately, both components 86 and 107 may each include identical algorithms that will generate a key such that subsequent to receiving a seed code the key generated in each of receivers 86 and 107 may be identical.

In a non-limiting example of a method of forming a wireless connection, component 107 may detect that the receiver information is zero. In another non-limiting example embodiment, receiver information of zero may indicate that no receiver is connected to component 107 and may indicate that component 107 must enter a pairing sequence in order to wirelessly link to another device such as computer 75. After receiver 108 is connected to computer 75, component 107 can then identify the left or right receiver and determine the security key to be use for pairing with computer 75. Similarly, if the receiver is disconnected, component 107 may be configured to reinitialize the wireless link and re-pair to computer 75 or alternately to re-designate component 107 as a left or right component.

Referring back to FIG. 8, in a non-limiting example embodiment of a system using wireless hearing aid components 86 and 107, it may be advantageous for components 86 and 107 to exchange information, or commands, or signals between components 86 and 107. For example, if the volume control of one of components 86 or 107, component 86 for example, is changed it may be advantageous for that component, component 86 for example, to send the changed volume setting to the other component, for example component 107. In some example embodiments, components 86 and 107 may want to exchange other control information or signal processing parameters between the components. In an embodiment, it may be advantageous for one of components 86 or 87 to be a master controller or master (or alternately primary controller) that controls or alternately initiates the exchange of information and other parameters between components 86 and 107. The other of components 86 and 107 could be a slave controller or slave (or alternately secondary controller or secondary) that performs operations after receiving commands from the master controller. This master slave relationship could facilitate components 86 and 107 communicating information between the components.

In an embodiment, components 86 and 107 may be configured with the same algorithms and same parameters as each other such that both has the capability to be a master controller or a slave controller. In one example embodiment, both of components 86 and 107 may be configured to operate as a master or slave according to the type of receiver attached to the component. For example, components 86 and 107 may be configured to operate as a master if a left receiver, such as receiver 108 that has a code consistent with table 90 of one, two, three, or four. For such an example, connecting receiver 108 to component 107 would designate component 107 as a master. Component 107 may be configured to detect the code assigned to receiver 108 and set component 107 to operate as the master. Alternately, connecting a right receiver 87 to component 86 could designate component 86 as a slave. For example, component 86 could read the code assigned to receiver 87, such as one of codes six, eight, nine, or twelve, according to table 90 which could cause component 86 to operate as a slave. Alternately, connecting receiver 108 to component 86 could designate component 86 as a master and connecting receiver 87 to component 107 could designate component 107 as a slave. Those skilled in the art will appreciate that the master could alternately be identified as the component to which a right receiver is attached. Those skilled in the art will appreciate that any of the codes could be used to designate a master or a slave component.

Assume for a non-limiting example that receiver 108 is connected to component 107 such that a component 107 is a master and that receiver 87 is connected to component 86 such that component 86 operates as a slave. Assume that a user changes a volume control 109 on component 107. Component 107 could change the volume. Component 107 would also initiate a communication with slave mode component 86 and present or transmit control information and settings information to slave 86. The control information and settings information may cause component 86 to set the volume according to the setting information. Assume that the user changes a volume control 89 on slave 86. Slave 86 may send a request to component 107 to change the volume of component 107 according to the control and settings information sent to component 107 by component 86. Master mode component 107 may be configured to send a command to slave 86 informing slave 86 to perform the volume change according to the settings information. Consequently even though component 86 is configured as a slave, changing the volume control on component 86 could still result in component 86 performing a volume change operation. Those skilled in the art will appreciate that the volume control is used as a vehicle to explain an example of the master-slave operation and that other control or setting information or changes may be used instead of or in addition to the volume control or volume setting information.

An embodiment may also include that components 86 and 107 may be configured to operate as a master depending on which of components 86 or 107 is turned on before the other. For example, if component 86 is turned on to begin operation, component 86 may begin operation as a master and send signals requesting information of another nearby component such as component 107. If component 86 receives a response, component 86 may be configured to determine which was turned on first. If component 107 was turned on first, component 86 may operate as a slave while component 107 operates as a master, and if component 86 was turned on first, component 107 may operate as a slave while component 86 operates as a master.

In another embodiment, components 86 and 107 may be configured to communicate information, control signals, and/or commands with a third device 120 (illustrated by a dashed box) which has a wireless communications capability. In an embodiment, device 120 may not be a personal amplification device, but may have capability to produce sound, such as for example a cellular telephone or a computer. For example, device 120 may be a cellular telephone or a computer or other device that has wireless communication capability. In some embodiments, it may be desirable for components 86 and/or 107 to communicate with or received signals from device 120 and form audio for a user of systems 105 and 106. In order to manage the connections between device 120, and components 86 and 107 it may be desirable for the master to form a connection to device 120 and then for the master to communicate with the slave and allow the slave to form a connection to device 120. Alternately, the slave may be configured to receive all information from the master and not communicate directly with device 120. If device 120 is disabled from sending or exchanging signals with either or both of components 86 and/or 107, components 86 and 107 may be configured to continue exchange signals or information with each other in the master-slave configuration. For example, device 120 may be powered off or may be removed to location that is too far away for components 86 and/or 107 to receive information from component 120.

Those skilled in the art will appreciate that the terminology "sending" or "exchanging" as related to sending signals or information or controls between components 86 and 107 or between device 120 and either/both of components 86 and 107 includes sending the signals or control information through a wireless communication connection between the respective elements.

Personal audio components may be equipped with user controls such as pushbuttons, switches or knobs. These user controls may permit the wearer or user to control certain functions within the component. Due to the small physical size of such components, user controls often may be very limited both in physical size and complexity. The information described herein, such as for example the codes and methods of detecting the codes, may be used to provide some user controls. A user action means any operation or action that a user of either of components 11, 86, or 107 may undertake to affect the operation of the components or associated system. Non-limiting examples of user action include changing a volume level, placing the component in a low-power operating mode to conserve battery power, responding to a request from the component to provide information or a response to a question, etc. In some embodiments, the user action may indicate that component 107 must enter a pairing sequence, such as described hereinbefore. For example, two components may have lost the pairing connection or synchronization between the two components. In other embodiments, the receiver information of zero may be defined to mean any of a variety of various different conditions.

In an embodiment, components 11, 85, or 107 may be configured to begin a specific method or specific operating flow in response to detecting a disconnected receiver for a first time interval and a re-connection of that same receiver, such as for example the same code or receiver information, and in response to the sequence begin an operation such as for example begin a pairing operation. An example embodiment may include that the reconnection may be at least the first time interval but less than a second time interval. Alternately, if the receiver is disconnected again within the second time-interval, the component may be configured to begin a different method. The component may also include another embodiment that is configured to begin the method in response to different combinations of disconnecting and reconnecting the same receiver, or alternately some other specific receiver/code, within the first time interval or alternately between the first time interval and the second time interval. In some embodiments, beginning the method may also be responsive to another disconnection and re-connection within the second time interval. In an embodiment, if the receiver is disconnected and reconnected within the first time interval the component may begin the specific method or specific operating flow. If the disconnection is for another time interval, such as for example a longer time interval or alternately a shorter time interval, the component may begin a different method or different operating flow. A non-limiting example embodiment of the different method or operating flow may include placing the component in a sleep mode. Another embodiment may include that if the receiver is disconnected for a time interval and a different receiver, for example a different code or different receiver information, is connected or received, the method or operating flow may be terminated. In some embodiments, the component may include a switch. An embodiment may include that if the switch is turned off for a first time interval and less than a second time interval, the component may begin the specific method or operating flow.

An embodiment may include that receiver information of zero may indicate that no receiver is connected to component 107 and may indicate that a user action is being performed. In a further embodiment, component 11, 86, or 107, may detect that the receiver information is zero and thereby determine that the receiver has been disconnected. The act of disconnecting and/or reconnecting the receiver may be used as an alternative user-control method for the component. An embodiment may include that disconnecting a receiver for a first time interval and re-connecting the component, either after or prior to expiration of the first time interval, may be a control sequence that causes the component to begin a particular method. For example a method for a user action. Another embodiment may include disconnecting the receiver for a first time interval, re-connecting the receiver after expiration of the first time interval followed by re-connecting the receiver and then disconnecting it for a second time interval may cause the component to begin another method. For example, disconnecting the receiver for a specific time period and then reconnecting the same receiver may be used to signal that the component enter a low-power sleep state to conserve battery life.

In another embodiment, the component may be configured to may detect that the receiver information is zero and thereby determine that the receiver has been disconnected. Following a specific time interval, the component may further detect that a receiver has been reconnected. If the reconnected receiver type is the same as the previous receiver type, this may be used to establish another time interval. If the receiver is again disconnected and reconnected within this another time interval, this may be used to signal that the component enter a specific mode or begin a method to permit testing of the wireless transmission functions. Such testing may be required to permit regulatory testing of the wireless transmission characteristics of the component.

Those skilled in the art will appreciate from all the foregoing that an embodiment of a sound amplification system, may comprise:

a controller, such as for example one of controllers 12 or 20, configured to control one or more output signals, such as for example signals out+ and/or out−, to excite a detachable device, such as for example one of devices 13 and/or 18;

one or more information inputs, inputs 33 and/or 34 for example, of the controller configured to receive one or more information signals, such as for example In0 and/or In1, and him from the detachable device wherein the one or more information signals are selectively (43/44) representative of codes (43/44) of the detachable device; and the controller configured to selectively set the controller to one of initiate a wireless connection with an external device in response to a first value of the codes or to initiate a method for a user action or to operate in one of a master mode or slave mode wherein operation in the master mode is initiated in response to receiving the one or more information signals representing the first value of the codes and operation in the slave mode is initiated in response to receiving the one or more information signals representing a second value of the codes, the master mode including the controller configured to send signals to control an operation of an external device operating in the slave mode.

An embodiment may include that the slave mode may include the controller wirelessly receiving signals from external to the controller and responsively changing operation of the controller.

In an embodiment, the slave mode may include the controller configured to wirelessly receive signals for setting a volume control of the controller to a selected value wherein the signals are received from an external controller operating in the master mode.

In some embodiments the slave mode may include the controller configured to receive information signals from another device that is not a personal sound amplification device and to responsively transmit other information signals to an external controller that is operating in the slave mode, wherein the other information signals may include data received from the external device.

In other embodiments, the slave mode may include the controller configured to transmit information to another controller operating in the master mode and to receive commands to perform operations from the another controller operating in the master mode.

An embodiment may include the controller configured to determine a value of the codes according to values of the one or more output signals and the one or more information signals.

Those skilled in the art will also appreciate that a an example of a method of forming a semiconductor device may comprise:

configuring a controller to form output signals to form an excitation signal to excite a detachable device;

forming the controller to receive information signals from the detachable device wherein the information signals are selectively representative of a code of the detachable device wherein values of the information signals represent the code; and forming the controller to one of initiate a wireless connection to an external device or to perform a user control method or to operate in one of a master mode or a slave mode according to a value of the code received from the detachable device wherein the master mode includes configuring the controller to wirelessly transmit a signal to another controller that is external to the controller and cause the another controller to change an operation according to information that is included in the signal.

Another embodiment of the method may include configuring the controller to operate in the master mode in response to receiving a first value of the information signals and to operate in the slave mode in response to a second value of the information signals.

An embodiment may include configuring the controller to operate in the master mode in response to receiving a first value of the code and to operate in the slave mode in response to a second value of the code.

The method may also have an embodiment that may include configuring the controller to transmit a command to change a setting of the another controller in response to a setting change on the controller.

In some embodiments the method may include configuring the controller to transmit a command to change a volume setting of the another controller in response to a volume setting change on the controller.

Another embodiment of the method may include configuring the controller to receive information from the another controller of a setting change on the another controller, to change a setting of the controller in response to receiving the information, and to send a command to the another controller to change a corresponding setting of the another controller.

An embodiment may include configuring the controller to connect to use the code to form a security key and transmit the security key to the external device.

In some embodiments the method may include that a code may be changed and responsively initiate a first time interval, to detect receiving the code again after termination and the first time interval and responsively initiate a second time interval, to detect removal of the code and again detect the code prior to expiration of the second time interval and responsively begin a method of operation.

Those skilled in the art will also appreciate that an example embodiment of another method of forming a semiconductor device for a personal sound amplification device may comprise:

forming a controller to form output signals to form an excitation signal to excite a detachable device;

forming the controller to receive information signals from the detachable device wherein the information signals are selectively representative of values of the output signals according to a connection configuration of the detachable device wherein values of the information signals correspond to codes; and configuring the controller to operate as one of a personal sound amplification device for a right ear or a personal sound amplification device for a left ear according to the codes.

The method may also have an embodiment includes configuring the controller to operate as an amplifier to amplify sound for a right ear in response to receiving a first value of the information signals or to operate as an amplifier to amplify sound for a left ear in response to receiving a second value of the information signals.

In another embodiment the method may include configuring the controller to identify the values of the information signals as representing one of a receiver for a right ear in response to a first value of the information signals or as a receiver for a left ear in response to a second value of the information signals.

Those skilled in the art will also appreciate that another example of an embodiment of a sound amplification system, may comprise a controller, such as for example controller 12 and/or 20, configured to control one or more output signals to excite a detachable device, such as for example device 13 and/or 18, the controller configured to receive one or more information signals, such as for example signals In0 and/or In1, from the detachable device wherein the one or more information signals have values representative of codes of configurations of the detachable device; and the controller configured to selectively set the controller to operate as one of an amplifier for a left ear of a person in response to receiving a first value of the one or more information signals or to operate as an amplifier for a right ear of a person in response to receiving a second value of the one or more information signals.

Another embodiment may include that the information signals may be selectively representative, such as for example selected by connections 43 and/or 44, of the one or more output signals according to codes of the detachable device.

In another embodiment the controller may be configured to determine a value of the code according to values of the one of more output signals and the one of more information signals.

In view of all of the above, it is evident that a novel device and method is disclosed. Included, among other features, is forming a personal amplification device that can wireless pair or connect to or send and receive signals from another personal amplification device or to another device that is not a personal amplification device. The personal amplification device may have an embodiment that receives signals representative of output signals and receives one or more sense signals that may be representative of information coded into a receiver. An embodiment may include that the personal amplification device can become either a master device or a slave device according to codes received from the detachable receiver. The master device may be configured to send signals to the slave device providing commands that allow the slave device to perform operations authorized by the master. The master may also be configured to send and receive signals from another device that is not a personal amplification device. The receiver information described herein or alternately the codes, facilitate configuring the component to perform methods that include adjusting parameters of the component, such as for a non-limiting example, receiver right/left dependence, wireless pairing of the component with an external component or other wireless device. Some of these operations may be left/right dependent.

While the subject matter of the descriptions are described with specific preferred embodiments and example embodiments, the foregoing drawings and descriptions thereof depict only typical and non-limiting examples of embodiments of the subject matter and are not therefore to be considered to be limiting of its scope, it is evident that many alternatives and variations will be apparent to those skilled in the art. Those skilled in the art will appreciate that although the foregoing example embodiments of a hearing aid are used as a vehicle for explaining the drawings, the embodiments can be used in other types of amplification devices such as for example personal sound amplifications. Those skilled in the art will appreciate that the foregoing descriptions use the receiver information or code of zero as a vehicle for explaining operations, methods, and actions that may be performed in response to the zero information or zero code, however, those skilled in the art will appreciate that any code can be used instead of the zero code or zero information. Additionally, table 50 and 90 indicate that specific codes have specific meanings, however, those skilled in the art will appreciate that the codes may be defined to have other meanings instead of the specific examples used for tables 50 and 90.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. A sound amplification system, comprising:

a controller configured to control one or more output signals to excite a detachable device;

one or more information inputs of the controller configured to receive one or more information signals from the detachable device wherein the one or more information signals are selectively representative of codes of the detachable device; and the controller configured to selectively set the controller to one of initiate a wireless connection with an external device in response to a first value of the codes or to initiate a method for a user action or to operate in one of a master mode or slave mode wherein operation in the master mode is initiated in response to receiving the one or more information signals representing the first value of the codes and operation in the slave mode is initiated in response to receiving the one or more information signals representing a second value of the codes, the master mode including the controller configured to send signals to control an operation of an external device operating in the slave mode.

2. The sound amplification system of claim 1 wherein the slave mode includes the controller wirelessly receiving signals from external to the controller and responsively changing operation of the controller.

3. The sound amplification system of claim 2 wherein the slave mode includes the controller configured to wirelessly receive signals for setting a volume control of the controller to a selected value wherein the signals are received from an external controller operating in the master mode.

4. The sound amplification system of claim 1 wherein the master mode includes the controller configured to receive information signals from another device that is not a personal sound amplification device and to responsively transmit other information signals to an external controller that is operating in the slave mode, wherein the other information signals may include data received from the external device.

5. The sound amplification system of claim 1 wherein the slave mode includes the controller configured to transmit information to another controller operating in the master mode and to receive commands to perform operations from the another controller operating in the master mode.

6. The sound amplification system of claim 1 wherein the controller is configured to determine a value of the codes according to values of the one or more output signals and the one or more information signals.

7. A method of forming a semiconductor device comprising:

configuring a controller to form output signals to form an excitation signal to excite a detachable device;

forming the controller to receive information signals from the detachable device wherein the information signals are selectively representative of a code of the detachable device wherein values of the information signals represent the code; and forming the controller to one of initiate a wireless connection to an external device or to perform a user control method or to operate in one of a master mode or a slave mode according to a value of the code received from the detachable device wherein the master mode includes configuring the controller to wirelessly transmit a signal to another controller that is external to the controller and cause the another controller to change an operation according to information that is included in the signal.

8. The method of claim 7 wherein forming the controller to one of initiate a wireless connection to the external device or to perform a user control method or to operate in one of the master mode or the slave mode includes configuring the controller to operate in the master mode in response to receiving a first value of the information signals and to operate in the slave mode in response to a second value of the information signals.

9. The method of claim 7 wherein forming the controller to one of initiate a wireless connection to the external device or to perform a user control method or to operate in one of the master mode or the slave mode includes configuring the controller to operate in the master mode in response to receiving a first value of the code and to operate in the slave mode in response to a second value of the code.

10. The method of claim 7 wherein configuring the controller to wirelessly transmit the signal includes configuring the controller to transmit a command to change a setting of the another controller in response to a setting change on the controller.

11. The method of claim 7 wherein configuring the controller to wirelessly transmit the signal includes configuring the controller to transmit a command to change a volume setting of the another controller in response to a volume setting change on the controller.

12. The method of claim 7 wherein configuring the controller to wirelessly transmit the signal includes configuring the controller to receive information from the another controller of a setting change on the another controller, to change a setting of the controller in response to receiving the information, and to send a command to the another controller to change a corresponding setting of the another controller.

13. The method of claim 7 wherein configuring the controller to one of initiate a wireless connection to the external device includes configuring the controller to connect to use the code to form a security key and transmit the security key to the external device.

14. The method of claim 7 wherein The method of claim 7 wherein forming the controller to one of initiate a wireless connection to the external device or to perform a user control method includes configuring the controller to detect that the code is changed and responsively initiate a first time interval, to detect receiving the code again after termination and the first time interval and responsively initiate a second time interval, to detect removal of the code and again detect the code prior to expiration of the second time interval and responsively begin a method of operation.

15. A method of forming a semiconductor device for a personal sound amplification device comprising:

forming a controller to form output signals to form an excitation signal to excite a detachable device;

forming the controller to receive information signals from the detachable device wherein the information signals are selectively representative of values of the output signals according to a connection configuration of the detachable device wherein values of the information signals correspond to codes; and configuring the controller to operate as one of a personal sound amplification device for a right ear or a personal sound amplification device for a left ear according to the codes.

16. The method of claim 15 wherein configuring the controller to operate includes configuring the controller to operate as an amplifier to amplify sound for a right ear in response to receiving a first value of the information signals or to operate as an amplifier to amplify sound for a left ear in response to receiving a second value of the information signals.

17. The method of claim 15 wherein configuring the controller to operate includes configuring the controller to identify the values of the information signals as representing one of a receiver for a right ear in response to a first value of the information signals or as a receiver for a left ear in response to a second value of the information signals.

18. A sound amplification system, comprising:

a controller configured to control one or more output signals to excite a detachable device, the controller configured to receive one or more information signals from the detachable device wherein the one or more information signals have values representative of codes of configurations of the detachable device; and the controller configured to selectively set the controller to operate as one of an amplifier for a left ear of a person in response to receiving a first value of the one or more information signals or to operate as an amplifier for a right ear of a person in response to receiving a second value of the one or more information signals.

19. The sound amplification system of claim 18 wherein the information signals are selectively representative of the one or more output signals according to codes of the detachable device.

20. The sound amplification system of claim 18 wherein the controller is configured to determine a value of the code according to values of the one of more output signals and the one of more information signals.

* * * * *